United States Patent [19]

Parslow, Jr. et al.

[11] Patent Number: 4,892,111

[45] Date of Patent: Jan. 9, 1990

[54] PRODUCTION LINE PART CLEANING APPARATUS

[75] Inventors: Harold W. Parslow, Jr.; Timothy M. Parslow, both of Mt. Clemens, Mich.

[73] Assignee: GraPar Corporation, Warren, Mich.

[21] Appl. No.: 65,280

[22] Filed: Jun. 22, 1987

[51] Int. Cl.[4] ..... B08B 3/02

[52] U.S. Cl. ..... 134/66; 34/58; 134/82; 134/153

[58] Field of Search ..... 134/66, 82, 133, 148, 134/149, 153, 157, 25.4, 33, 159; 34/8, 58

[56] References Cited

U.S. PATENT DOCUMENTS

| | | | |
|---|---|---|---|
| 2,181,503 | 11/1939 | Biggert | 134/149 X |
| 2,483,477 | 10/1949 | Shorter | 134/149 X |
| 2,580,344 | 12/1951 | Clayborne | 134/149 X |
| 2,596,345 | 5/1952 | Pernod | 134/149 X |
| 2,616,549 | 11/1952 | Ornitz | 134/149 X |
| 2,726,642 | 12/1955 | Zinty et al. . | |
| 2,824,029 | 2/1958 | Zinty . | |
| 2,857,923 | 10/1958 | Zinty . | |
| 2,972,995 | 2/1961 | Umbricht et al. | 134/153 X |
| 3,022,790 | 2/1962 | Carrie . | |
| 3,047,436 | 7/1962 | Zinty . | |
| 3,074,417 | 1/1963 | Lisowski et al. . | |
| 3,083,716 | 4/1963 | Rowan et al. . | |
| 3,166,082 | 1/1965 | Arnold et al. | 134/153 X |
| 3,578,002 | 5/1971 | Rowan et al. . | |
| 3,608,568 | 9/1971 | Hallsworth . | |
| 3,615,824 | 10/1971 | Hittel et al. . | |
| 3,633,594 | 1/1972 | Boundy . | |
| 3,699,983 | 10/1972 | Morley . | |
| 3,979,220 | 9/1976 | Ishiyama et al. . | |
| 4,090,907 | 5/1978 | Anderson | 134/153 X |
| 4,240,453 | 12/1980 | Vial et al. . | |
| 4,424,082 | 1/1984 | Rowan . | |
| 4,432,629 | 2/1984 | Caflisch | 134/149 X |
| 4,458,704 | 7/1984 | Higdon | 134/153 X |

FOREIGN PATENT DOCUMENTS

| | | | |
|---|---|---|---|
| 1446456 | 6/1966 | France | 134/82 |

*Primary Examiner*—Philip R. Coe
*Assistant Examiner*—Stephen F. Gerrity
*Attorney, Agent, or Firm*—Basile and Hanlon

[57] ABSTRACT

Apparatus for cleaning manufactured parts, each part having an established axis of rotation, includes a conveyor operable to convey the parts in succession in intermittant step-by-step movement to a cleaning station and a drying station. At each of the cleaning and drying stations the part is driven in rotation about its axis by a part rotating device. At the cleaning station the rotating part is sprayed with cleaning fluid and at the drying station air is discharged tangentially against the rotating part to strip residal cleaning fluid from the part.

4 Claims, 2 Drawing Sheets

PRODUCTION LINE PART CLEANING APPARATUS

BAKCGROUND OF THE INVENTION

The present invention is directed to apparatus employed to clean manufactured metal parts on a production line basis and is especially concerned with the cleaning of parts such as engine crank shafts, cam shafts, vehicle axles, etc. which have an established axis of rotation.

Prior art approaches to cleaning of manufactured metal parts typically involve either the conveying of the parts through a spray booth past a battery of nozzles which spray cleaning fluid onto the parts or by immersing the parts in a tank of cleaning solution. In some cases, to increase the volume of parts passing through the cleaning system, tote boxes filled with parts are conveyed through a booth in which the tote boxes are flooded or overfilled with cleaning solution or the entire tote box is immersed in a tank of cleaning solution in which either or both of the bath and tote box are aggitaged.

In general the prior art approaches all require large volumes of cleaning fluid and require a difficult compromise between thoroughness of cleaning and production output rate. Systems which employ tote boxes filled with loose parts obviously are not acceptable for cleaning parts having machined surfaces, particularly if the tote box is to be flooded with cleaning fluid and then tilted or inverted to drain the box or if the box is to be agitated in a bath of cleaning fluid.

The present invention is especially directed to a part cleaning system in which manufactured parts having an established axis of rotation, such as engine crank shafts, for example, may be thoroughly cleaned and dried individually on a production line basis.

SUMMARY OF THE INVENTION

In accordance with the present invention, like parts, each having an established axis of rotation, are conveyed in succession in intermittent step-by-step movement by a conveyor to a cleaning station and then to a drying station located downstream of the conveyor from the cleaning station.

In the present invention, at the cleaning station and at the drying station, similar part rotating devices are mounted. Each part rotating device consists of a pair of opposed spindles mounted for rotation about a fixed horizontal axis which is normal to the conveying path and so located as to be coaxially aligned with the axis of rotation of a part mounted on the conveyor carrier when the carrier is at the end of its forward stroke. The spindles are mounted for coordinated movement toward and away from each other and are normally retracted from each other to permit a part to be moved between the two spindles by the conveyor. When the part is axially aligned between the two spindles, the conveyor is temporarily held stationary and the spindles are moved toward each other to seat against opposite ends of the part. The part is then discharged from the conveyor, leaving the part coaxially gripped between the two spindles. While the part is so gripped, one of the spindles is driven in rotation.

At the cleaning station, a set of spray nozzles are located to discharge cleaning fluid in high pressure jets which are directed at predetermined areas of the part as the part is being driven in rotation. At the drying station, the part is driven in high speed rotation to centrifugally spin cleaning fluid off the part while a high velocity stream of air is discharged from an elongate slot-like nozzle opening having a length commensurate with the length of the part in a path tangential to the rotating part at a location where the rotating part is moving in a direction opposite to that of the air stream.

At the start of the next cycle of movement of the conveyor, the carrier on its elevating stroke moves upwardly into engagement with the spindle supported parts at the cleaning and drying stations and the spindles of the rotating devices are retracted.

By employing cleaning fluid and drying air under relatively high pressures and by rapidly rotating the parts while they are being sprayed and dried, the parts may be handled individually and thoroughly cleaned and dried in a relatively short cycle time.

Other objects and features of the invention will become apparent by reference to the following specification and to the drawings.

IN THE DRAWINGS

Figure 1:
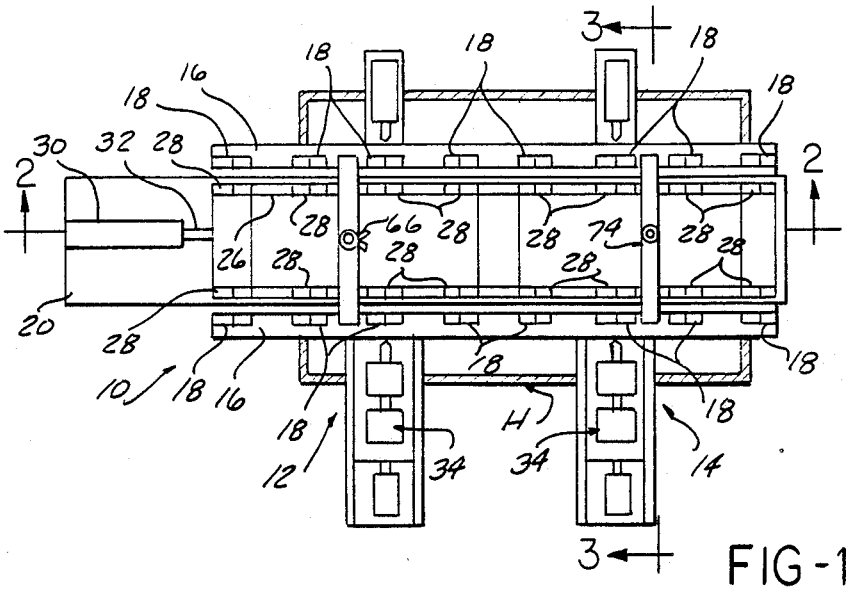
FIG. 1 is a schematic top plan view of one form of apparatus embodying the present invention with certain parts omitted or shown in section.
Figure 2:
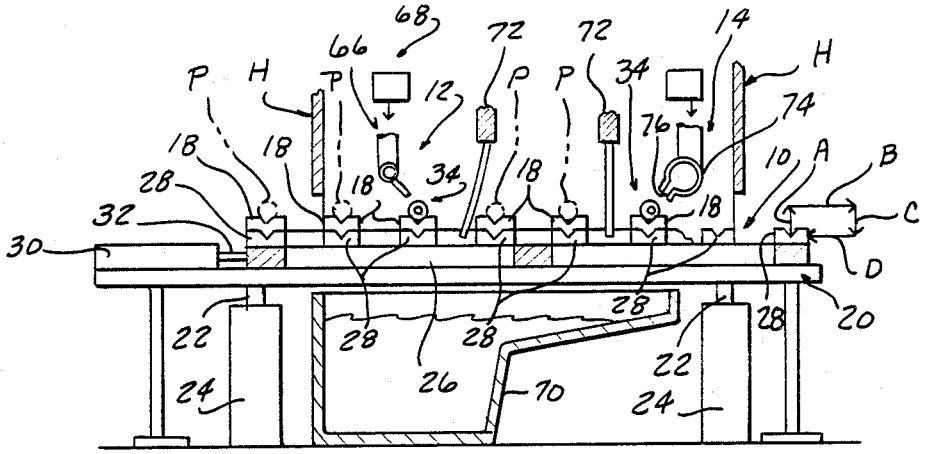
FIG. 2 is a schematic cross-sectional view of the apparatus of FIG. 1, with certain parts omitted, added, broken away and shown in section.

An exemplary form of parts cleaning apparatus embodying the present invention includes, as best seen in FIGS. 1 and 2, a conveyor designated generally 10 which is adapted to convey like manufactured parts, each having an established axis of rotation, in step-by-step movement along a path in which the parts are advanced in succession to a cleaning station designated generally 12 and then to a drying station designated generally 14.

Conveyor 10 has been illustrated schematically because it may take any of several forms of conveyors of the general type referred to as walking beam conveyors or lift and carry conveyors. Such a conveyor typically includes a pair of spaced parallel fixed side frame members 16 which extend along opposite sides of the conveyor and fixedly support a plurality of uniformly spaced cradle blocks 18. As best seen in FIG. 2, the cradle blocks 18 may be formed with a V-shaped notch in their upper surface which is adapted to receive an locate the end of a shaft-like part P. The two aligned cradle blocks 18 at opposite sides of conveyor 10 will support the part with the rotative axis of the part extending transversely across the conveyor in a direction perpendicular to the path of movement of parts along the conveyor. The particular parts P may, for example, be engine crank shafts, cam shafts, or other shaft type parts formed with coaxial shaft-like portions at opposite ends which define the established axis of rotation of the part.

The conveying portion of conveyor 10 which is operable to move the parts in step-by-step movement from one pair of stationary cradle blocks 18 to the next may include a lift platform designated generally 20 which extends horizontally and may be supported upon the piston rods 22 (FIG. 2) of a pair of vertically disposed lift cylinders 24. A carrier frame 26 is slidably mounted upon the top of platform 20 for horizontal reciprocation between side frame members 16. Carrier frame 26 carries along each of its opposite sides uniformly spaced sets of cradle blocks 28 of a construction and spacing the same as the stationary cradle blocks 18. A reciprocatory drive cylinder 30 is fixedly mounted upon platform 20 and its piston rod 32 is connected to carrier frame 26 to drive carrier frame 26 in horizontal reciprocatory movement.

In FIGS. 1 and 2, platform 20 and carrier frame 26 are shown in their normally maintained start position in which the piston rods 22 of cylinders 24 are in their retracted position to locate platform 20 at its lowermost end limit of movement and piston rod 32 of drive cylinder 30 is likewise in its retracted position, establishing carrier frame 28 at its extreme left-hand end limit of movement as shown in FIGS. 1 and 2.

In operation, cylinders 24 and 30 are driven in a coordinated cycle. The first step of this cycle finds lift cylinders 24 being actuated to extend their piston rods 22 and lift platform 20 upwardly from the position shown in FIG. 2. This upward movement of platform 20 carries with it carrier frame 26, and as the platform rises the cradle blocks 28 on carrier frame 26 move upwardly into engagement with the parts P supported upon stationary cradles 18 and lift the parts upwardly clear of cradles 18 when the platform reaches its fully elevated position. This upward movement of platform 20 is indicated by the arrow A at the right-hand end of FIG. 2.

Platform 20 is held in this elevated position and drive cylinder 30 is then actuated to extend its piston rod 32 to drive carrier frame 26 to the right as viewed in FIG. 2 to carry the parts P supported upon carrier frame 20 forwardly a distance equal to the spacing between adjacent carrier blocks 18. This movement is indicated by the arrow B at the right-hand end of FIG. 2. This movement of carrier frame 26 carries each part forwardly (to the right as viewed in FIGS. 1 and 2) from vertical alignment with one set of cradle blocks 18 into vertical alignment with the next adjacent set of carrier blocks 18.

The next step in the conveying cycle finds lift cylinders 24 actuated to lower platform 20 back to its original elevation, as indicated by the arrow C in FIG. 2. During this lowering movement, support of the parts is transferred back to the stationary cradle blocks 18 and platform 20 is lowered until its cradle blocks 28 are vertically clear of the parts.

The next and final step in the cycle finds drive cylinder 30 actuated to retract its piston rod to return carrier frame 26 to its original start position, this movement being indicated by the arrow D in FIG. 2.

A part rotating device designated generally 34 is located at each of cleaning station 12 and drying station 14. Both of the part rotating devices 34 are of similar construction, this construction being best illustrated in FIG. 3.

Figure 3:
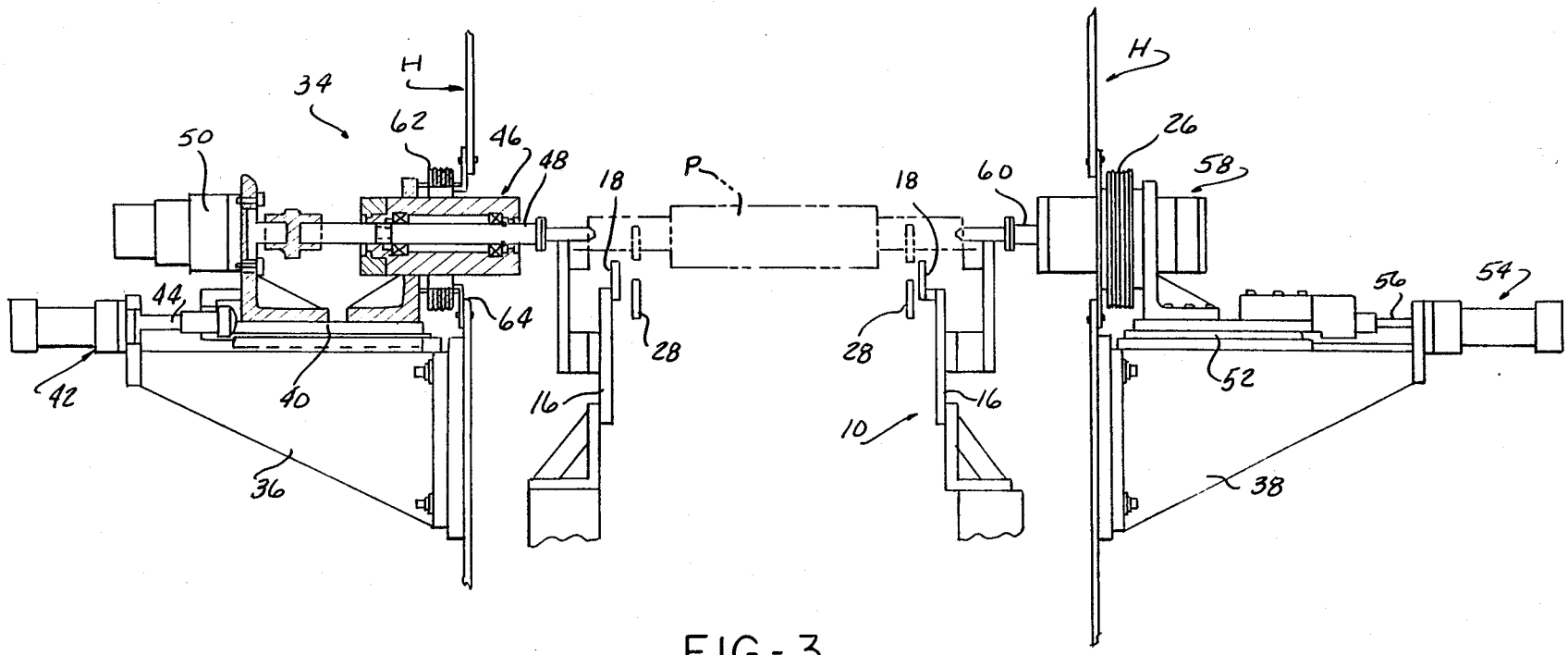
FIG. 3 is a cross-sectional view taken on line 3—3 of FIG. 1, with certain parts omitted or shown in section.

Referring now to FIG. 3, each part rotating device 34 includes a first stationary platform 36 and a second stationary platform 38, the platforms 36 and 38 being fixedly mounted in transverse alignment with each other at opposite sides of conveyor 10. A carrier plate 40 is slidably mounted upon the top surface of platform 36 for horizontal movement toward and away from the conveyor center line and a reciprocating piston motor designated generally 42 has its cylinder fixedly mounted upon platform 40 and its piston rod 44 coupled to carrier plate 40 to drive the carrier plate in movement from left to right and vice versa as viewed in FIG. 3, plate 40 being shown at its right-hand end limit of movement as viewed in FIG. 3.

At the end of carrier plate 40 adjacent conveyor 10, a bearing sleeve designated generally 46 rotatively supports a spindle 48 for rotation about a horizontal axis normal to the direction of movement of the parts along conveyor 10, which is toward the observer as viewed in FIG. 3. Carrier plate 40 also carries a rotary drive motor 50 coupled to spindle 48 and operable to drive spindle 48 in rotation about its axis.

The opposite platform 38 of part rotating device 34 likewise supports a carrier plate 52 for horizontal sliding movement toward and away from the center line of conveyor 10, a reciprocating piston motor 54 having its cylinder fixedly mounted on platform 38 and its piston rod 56 coupled to carrier plate 52 to reciprocate the plate in horizontal movement from right to left and vice versa as viewed in FIG. 3. Carrier plate 52 is at its left-hand end limit of movement as viewed in FIG. 3.

Like carrier plate 40, carrier plate 52 carries a bearing sleeve designated generally 58 of a construction similar to bearing sleeve 46, a second spindle 60 being supported in sleeve 58 for free rotation about a horizontal axis which is coaxially aligned with the axis of rotation of the driven spindle 48 at the opposite side of the conveyor.

The carrier plates 40 and 52 are normally disposed in a retracted position in which the piston rods 44 and 56 of motors 42 and 54 are retracted further into their respective cylinders than is illustrated in FIG. 3. When so retracted, the ends of the respective spindles 48 and 60 are axially spaced from each other by a distance greater than the axial length of parts P which are to be cleaned and dried. When the carrier plates are in their extended position shown in FIG. 3, a part P is coaxially engaged at its opposite ends by the spindles 48 and 60 and supported clear of cradles 18 of the conveyor. The part P so engaged by the spindles may thus be driven in rotation about its axis by operation of motor 50.

When the platforms 40 and 52 are located in their retracted positions, the parts P may be moved into and from positions between the retracted spindles 48 and 60.

The aligned axes of spindles 48 and 60 are so located relative to the conveyor that, referring to FIG. 2, when the conveyor reaches the right-hand end of stroke B of its cycle, the rotational axis of part P is coaxially aligned with the retracted spindles. Motors 42 and 54 are actuated to drive spindles 48 and 60 inwardly to engage the aligned part P after the completion of stroke B of the conveyor and before the commencement of stroke C.

Because the cleaning and drying operations are preferably performed within a housing designated generally H, a bellows like seal 62 may be connected between the housing and bearing sleeves 46 to seal the opening, such as 64 in the housing through which the bearing sleeve is reciprocated.

Returning now to FIGS. 1 and 2, at cleaning station 12, a nozzle manifold 66 is mounted at a location such that jets of cleaning fluid may be discharged from the manifold 66 against a part P held by the part rotating device 34 located at the cleaning station. Manifold 66 is supplied with cleaning fluid under pressure from a valve controlled pressurized source of cleaning fluid schematically illustrated at 68. The configuration of manifold 66 and the location and orientation of various discharge nozzles on the manifold will be conformed to the configuration of the part P being cleaned to provide a thorough exposure of the part to the jets of cleaning fluid discharged from manifold 66. The part will be driven in rotation while being sprayed so that a thorough exposure of the part to the cleaning fluid is achieved. A collection tank 70 (FIG. 2) is located below the cleaning station to collect cleaning fluid. Fluid collected in tank 70 may be filtered and recycled to the cleaning fluid source 68. Preferably, one or more curtains such as 72 may be mounted within housing 10 to isolate cleaning station 12 from drying station 14.

At drying station 14, an elongate manifold 74 is located and oriented to discharge a relatively thin stream of cleaning air against a part supported in the part rotating device 34 located at drying station 14. Manifold 74 will be configured in accordance with the configuration of the particular parts P being handled, but in general will take the form of an elongated tubular housing having a slot-like axially extending discharge opening 76 oriented to discharge air in a sheet-like flow path which is tangential to the part B held in in part rotating device 34. The direction of rotation of part rotating device 34 at cleaning station 14 is chosen such that that portion of the part against which the airstream is discharged is driven in a direction opposite to the direction of air flow so that the air flow tends to strip the cleaning fluid from the rotating part surface.

While the embodiment described above speaks in terms of a walking beam or lift and carry type conveyor, it is believed apparent that the basic task of the conveyor is to simply convey parts in succession into position between the spindles of the part rotating device and to permit the part to be rotated at this fixed location during the cleaning and drying operations. Thus, other types of conveyors, such as accumulating conveyors might well be employed. While the apparatus has been shown with separate cleaning and drying stations, in some applications the cleaning and drying operations might be performed sequentially at a single station.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. An apparatus for production line spraying of like parts, each part having an established axis of rotation, said apparatus comprising:

conveying means operable to advance shaft-like parts in succession in intermittent step-by-step movement along a fixed path by cyclically lifting a part above stationary cradle blocks, carrying said part downstream along said fixed path of movement, lowering said conveying means below said stationary cradle blocks, and returning said conveying means upstream along said fixed path of movement;

first and second stationary platforms fixedly mounted in transverse alignment with each other at opposite sides of the conveying means and elevated above the stationary cradle blocks along the elevated downstream path of movement for said parts;

first and second carrier plates slidably mounted on the first and second stationary platforms respectively for horizontal movement toward and away from said parts;

first and second spindles rotatively supported by said first and second carrier plates respectively for rotation about a co-axial horizontal axis normal to the path of movement of the parts;

means for reciprocating the first and second carrier plates from a retracted position, wherein the first and second spindles are axially spaced from each other by a distance greater than an axial length of said parts, to an extended position, wherein the first and second spindles are co-axially engaging opposite ends of a part supported clear of the stationary cradle blocks at a downstream elevated first position;

part rotating means connected to one of the spindles for rapidly rotating said part by driving the spindle and engaged part in rotation about said co-axial horizontal axis when said first and second spindles are in the extended position coaxially aligned with the established axis of rotation for the part while the other of the spindles rotates freely; and spray means adjacent said first location actuable to discharge pressurized cleaning fluid against said part while said part is being driven in rotation by said part rotating means.

2. The apparatus according to claim 1 further comprising drying means operable subsequent to the operation of said spray means for centrifugally stripping fluid from said part by directing a sheet-like high velocity air stream against said part to blow residual cleaning fluid from said part, wherein said drying means directs said sheet-like air stream along a path tangential to the rotating part such that the portion of said part within said air stream moves in a direction opposite to said air stream.

3. An apparatus for production line spraying of like parts, each part having an established axis of rotation, said apparatus comprising:

a pair of spaced parallel fixed side frame members;

a plurality of spaced first cradle blocks aligned and fixedly supported on opposite sides of the parallel frame members to support a shaft-like part with an established axis of rotation extending transversely therebetween in a direction perpendicular to a path of movement of said parts;

a lift platform extending horizontally between the parallel side frame members;

means supporting said lift platform for vertical reciprocation between an upper position and a lower position;

a carrier frame slidably mounted on the lift platform for horizontal reciprocation along said path of movement between the parallel side frame members;

a plurality of spaced second cradle blocks aligned and fixedly supported on opposide sides of the carrier frame to support said shaft-like part with said axis extending therebetween perpendicular to said path of movement;

means for reciprocating the carrier frame between an upstream position and a downstream position along said path of movement, wherein the lift platform and carrier frame operate cyclically such that the lift platform reciprocating means raises the lift platform from the lower position to the upper position to transfer the shaft-like parts from the firsr cradle blocks to the second cradle blocks, the carrier frame reciprocating means operates to carry the shaft-like parts downstream along the path of movement, the lift platform reciprocating means lowers the lift platform from the upper position to the lower position transferring the shaft-like part from the second cradle blocks to the first cradle blocks, and the carrier frame reciprocating means returns the carrier platform from the downstream position to the upstream platform;

first and second stationary platforms fixedly mounted in transverse alignment with each other at opposite sides of said parallel side frame members and elevated above the side frame members along the horizontal path of movement for said parts;

first and second carrier plates slidably mounted on the first and second stationary platforms respectively for horizontal movement toward and away from said parts;

first and second spindles rotatively supported by said first and second carrier plates respectively for rotation about a co-axial horizontal axis normal to the path of movement of the parts;

means for reciprocating the first and second carrier plates from a retracted position wherein the first and second spindles are axially spaced from each other by a distance greater than an axial length of said parts to an extended position wherein the first and second spindles are co-axially engaging opposite ends of a part supported clear of the first cradle blocks at the downstream position;

part rotating means connected to one of the spindles for rapidly rotating said parts by driving the spindle in rotation about said coaxial horizontal axis when said first and second spindles are in the extended position co-axially aligned with the established axis of rotation for the part while the other of said spindles rotates freely;

a source of cleaning fluid under pressure;

nozzle means operable when connected to said source of cleaning fluid under pressure for discharging high pressure jets of cleaning fluid against predetermined portions of said part while said part is being driven in rotation by said spindle;

normally closed valve controlled means operable to connect said nozzle means to said source of cleaning fluid under pressure;

a source of air under pressure;

nozzle means operable when connected to said source of air under pressure for centrifugally stripping fluid from said part by discharging a sheet-like high velocity flow of air tangential to said part in a direction opposite to the rotating part surface; and normally closed valve controlled means operable to connect said nozzle means to said source of air under pressure after deactivation of said cleaning fluid valve controlled means.

4. An apparatus for production line spraying of like parts, each part having an established axis of rotation, said apparatus comprising:

a pair of spaced parallel fixed side frame members;

a plurality of spaced first cradle blocks aligned and fixedly supported on opposite sides of the parallel frame members to support a shaft-like part with an established axis of rotation extending transversely therebetween in a direction perpendicular to a path of movement of said parts;

a lift platform extending horizontally between the parallel side frame members;

means supporting said lift platform for vertical reciprocation between an upper position and a lower position;

a carrier frame slidably mounted on the lift platform for horizontal reciprocation along said path of movement between the parallel side frame members;

a plurality of spaced second cradle blocks aligned and fixedly supported on opposite sides of the carrier frame to support said shaft-like part with said axis extending therebetween perpendicular to said path of movement;

means for reciprocating the carrier frame between an upstream position and a downstream position along said path of movement, wherein the lift platform and carrier frame operate cyclically such that the lift platform reciprocating means raises the lift platform from the lower position to the upper position to transfer the shaft-like parts from the first cradle blocks to the second cradle blocks, the carrier frame reciprocating means operates to carry the shaft-like parts downstream along the path of movement, the lift platform reciprocating means lowers the lift platform from the upper position to the lower position transferring the shaft-like part from the second cradle blocks to the first cradle blocks, and the carrier frame reciprocating means returns the carrier platform from the downstream position to the upstream position;

first and second stationary platforms fixedly mounted in transverse alignment with each other at opposite sides of said parallel side frame members and elevated above the side frame members along the horizontal path of movement for said parts;

first and second carrier plates slidably mounted on the first and second stationary platforms respectively for horizontal movement toward and away from said parts;

first and second spindles rotatively supported by said first and second carrier plates respectively for rotation about a co-axial horizontal axis normal to the path of movement of the parts;

means for reciprocating the first and second carier plates from a retracted position wherein the first and second spindles are axially spaced from each other by a distance greater than an axial length of said parts to an extended position wherein the first and second spindles are co-axially engaging opposite ends of a part supported clear of the first cradle blocks at the downstream position;

part rotating means connected to one of the spindles for rapidly rotating said parts by driving the spindle in rotation about said co-axial horizontal axis when siad first and second spindles are in the extended position co-axially aligned with the established axis of rotation for the part while the other of said spindles rotates freely;

spray means adjacent said first location actuable to discharge pressurized cleaning fluid against said part while said part is being driven in rotation by said spindle; and drying means operable subsequent to the operation of said spray means for centrifugally stripping fluid from said part by directing a sheet-like high velocity air stream against said part to blow residual cleaning fluid from said part, wherein said drying means directs said sheet-like air stream along a path tangential to the rotating part such that the portion of said part within said air stream moves in a direction opposite to said air stream.

* * * * *